United States Patent [19]

Pawl

[11] 4,040,632

[45] Aug. 9, 1977

[54] SPORTS TRAINING AID

[76] Inventor: Eddie Pawl, 31246 Gay, Roseville, Mich. 48066

[21] Appl. No.: 646,017

[22] Filed: Jan. 2, 1976

[51] Int. Cl.[2] ..... A63B 69/36; A63B 69/38

[52] U.S. Cl. ..... 273/189 A; 273/54 B; 273/73 R; 128/77; 128/DIG. 15

[58] Field of Search ..... 273/54 B, 73 R, 75, 273/77 R, 166, 189 R, 189 A; 2/16, 20, 161 A, 162; 128/87 R, 165, 169, DIG. 15, 77, 327

[56] References Cited

U.S. PATENT DOCUMENTS

| | | | |
|---|---|---|---|
| 2,794,638 | 6/1957 | Risher et al. | 273/54 B |
| 3,241,881 | 3/1966 | Carnahan et al. | 128/DIG. 15 |
| 3,423,095 | 1/1969 | Cox | 273/54 B X |
| 3,512,776 | 5/1970 | Thomas | 128/165 X |
| 3,533,407 | 10/1970 | Smith | 273/54 B X |
| 3,606,342 | 9/1971 | Albertson | 273/189 R |
| 3,779,550 | 12/1973 | Benoun et al. | 273/54 B |
| 3,829,090 | 8/1974 | Ensinger | 273/54 B |
| 3,935,858 | 2/1976 | Harroff | 128/165 X |
| 3,942,525 | 3/1976 | Dragan | 273/54 B X |
| 3,970,305 | 7/1976 | Hawkins | 273/54 B |

*Primary Examiner*—Richard J. Apley
*Attorney, Agent, or Firm*—Cullen, Settle, Sloman & Cantor

[57] ABSTRACT

A removable training aid for sports such as golf or tennis or the like adapted to be worn on the wrist and hand to prevent bending of the wrist in either direction without interferring with the gripping action of the hand. The sports training aid is a relatively thin generally U-shaped member having a base and spaced apart first and second elongated legs. The base is enlarged, parallel to the elongated axis of the legs, to fit over the back of the hand, the wrist and the lower portion of the forearm. The first leg is wider than the second leg in a direction transverse to the longitudinal axis of the legs and fastener means are provided on the distal end of each leg and on the base. Upon placing the training aid base on the back of the hand, the wrist and the outside of the forearm, the first leg is encircled about the wrist and fastened to the base and the second leg is encircled about the hand, passing between the thumb and forefinger and then across the palm and then around to the back of the hand where it is attached to the base.

4 Claims, 6 Drawing Figures

FIG. 2

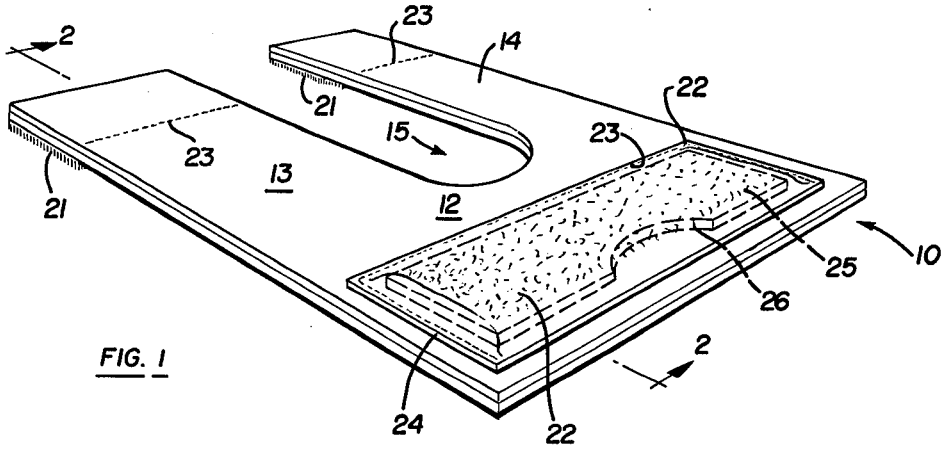
FIG. 1
FIG. 2
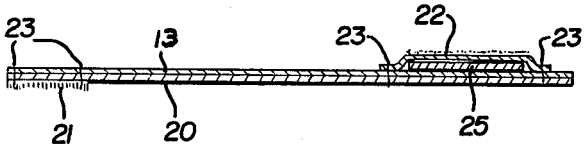
FIG. 6
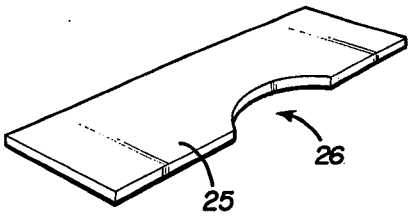
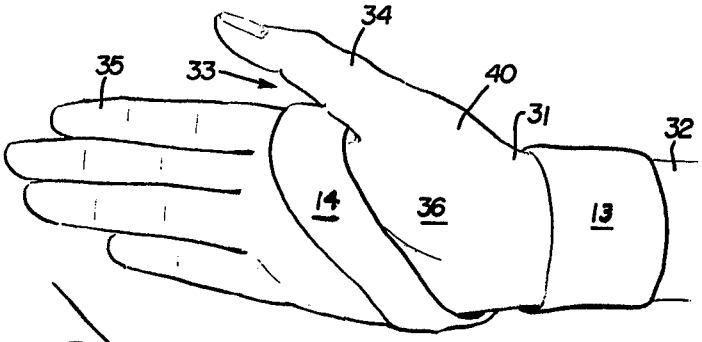
FIG. 3
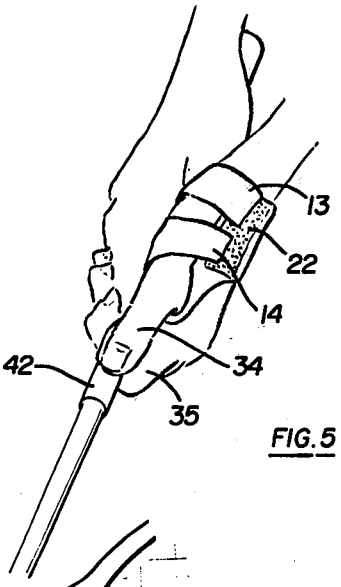
FIG. 5
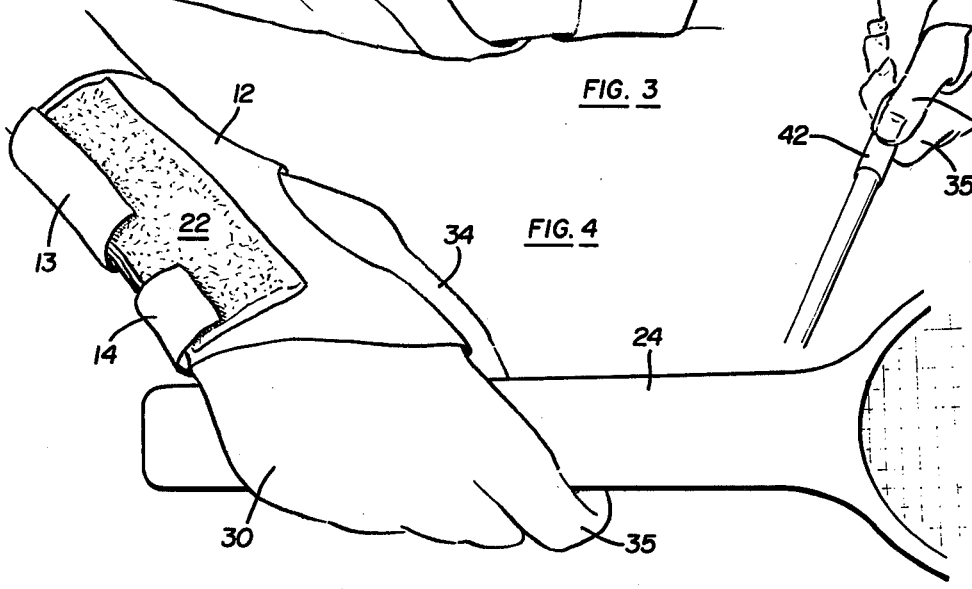
FIG. 4

SPORTS TRAINING AID

BACKGROUND OF THE INVENTION

In various sporting endeavors including but not limited to golf and tennis, it is preferable to lock the wrist rigidly and to prevent bending of the wrist. However, most sports enthusiasts who participate in these sports on a primarily social level, find it quite difficult to avoid bending the wrist due to the expected lapses in concentration.

Thus the present invention contemplates a sports training aid, particularly for golf and tennis, to be worn on the hand and wrist of the sports participant, which will prevent bending of the wrist and yet will not interfere with the normal gripping function of the hand.

SUMMARY OF THE INVENTION

The present invention contemplates a removable training aid for various sports such as golf or tennis or the like to be worn on the wrist and hand to prevent bending of the wrist without interfering with the normal gripping action of the hand. The training aid is a relatively thin generally U-shaped member having a base and opposed spaced apart first and second elongated legs. The base is enlarged in a direction parallel to the axis of the legs to thus define an enlarged base which fits over the back of the hand, the wrist and the lower portion of the back of the forearm. The first leg is wider than the second leg in a direction transverse to the longitudinal axis of the legs and fastener means such as Velcro fasteners or a knapped fibre are provided on the distal end of each leg and on the base. When the training aid is placed on the wearer, the enlarged base covers the back of the hand, the wrist and the back of the forearm and the first leg is wrapped completely around the wrist and fastened to the base. The second leg is passed between the thumb and forefinger of the wearer and then across the palm and around the back of the hand to be attached to the base. In this fashion, the ball of the thumb, which is well known to be important in gripping golf clubs, tennis racquets and the like, is not interfered with by the training aid.

The present invention also contemplates a pocket on the base to receive a rigid reinforcing member such as a plastic or metal plate and the plate may have a recess to accommodate the wrist bone of the wearer. Cushioning or padding material may be secured to the underside of the training aid, i.e., the side of the training aid in contact with the wearer.

BRIEF DESCRIPTION OF THE DRAWINGS

Various objects and advantages of the present invention will become more apparent upon reading the following detailed description of the invention taken in conjunction with the drawings.

In the drawings, wherein like reference numerals identify corresponding components:

FIG. 1 is a perspective illustration of the training aid of the present invention;

FIG. 2 is a cross-sectional illustration of the training aid of the present invention as seen in the plane of the arrows 2—2 of FIG. 1;

FIG. 3 is an illustration of the training aid properly positioned on a wearer showing the palm, wrist and inside forearm of the wearer and illustrating how the training aid does not interfere with the normal gripping action;

FIG. 4 is a partial perspective illustration of the training aid being worn on the hand illustrating in greater detail the fastening of the training aid in place and further illustrating the gripping of a tennis racquet by the wearer;

FIG. 5 is a partial perspective illustration of the training aid being worn in conjunction with the gripping of a golf club; and FIG. 6 is a perspective illustration of the reinforcing plate of the present invention.

DETAILED DESCRIPTION OF THE INVENTION

As illustrated in the drawings, the training aid 10 of the present invention is adapted to be worn on the hand 11. Specifically, the training aid is adapted to be worn on the "active" hand, i.e., the right hand of a right-handed sports participant.

The training aid includes a base 12 and first and second spaced apart opposed legs 13 and 14 with the base and legs defining a generally U-shaped member. The first leg 13 is wider than the second leg 14 along an axis transverse to the elongated axis of the legs. The base 12 of the training aid is enlarged in a direction parallel to the elongated axis of the legs. A space 15 is defined between the two legs and since the first leg 13 is wider than the second leg, the space 15 is necessarily offset from the center of the training aid.

In a preferred embodiment, the training aid is manufactured of a fabric such as leather and a second layer of a cloth or padding material 20 is secured to the underside of the training aid. The padding layer 20 is coextensive with the previously described base, first and second legs.

At the underside of the legs, or on the underside of the padding if in fact padding is used, and specifically at the distal ends of the legs, a fastener 21 is provided such as Velcro fasteners or a fastener having a knapped fiber. A similar fastener means 22 is provided along the upper portion of the base 12. Each Velcro fastener may be attached by conventional stitching 23 to the distal end of each leg and to the base 12, respectively.

Since different sports participants require a different degree of assistance from a training aid, provision is made for a reinforcing plate of a stronger material such as rigid plastic, metal or the like. In order to provide for such a reinforcing member, the Velcro or knapped fiber fastener 22 on the base is stitched on three sides with the fourth side 24 being open to thus define a pocket between the fastener and the base 12. The fastener material is, of course, knapped on the outside and smooth on the inside and thus does not interfere with the insertion of a reinforcing member 25 into the pocket.

The reinforcing member is a generally thin flat rectangular-shaped plate of rigid plastic or metal and may be recessed as at 26 on one elongated edge thereof to avoid contact with the wrist bone of the wearer.

Having thus described the training aid, reference should be had to the drawings to further understand the various benefits to be afforded by its use. When the base 12 of the training aid is placed on the back of the hand 30, it extends past the wrist 31 and onto the back forearm 32. In this position, the wide leg 13 is completely encircled about the wrist until the distal end of the leg 13 is positioned over the fastener 22 on the base. At this point, the knapped fibers are interengaged to tightly bind the training aid to the hand of the wearer.

Next, the narrow leg 14 is extended through the "V" 33 between the thumb 34 and the forefinger 35 of the wearer, and across the palm 36 and then around and onto the back of the hand 30 where the fastener 21 is again attached to the base by interengaging the knapped fibers.

By particular reference to FIG. 3 it may be seen that the base or ball 40 of the thumb is not interfered with by the training aid. This is of particular importance in sports such as golf or tennis where it is necessary that the handle of the racquet 41 or club 42 be positively contacted by the ball of the thumb.

Since the hand and the forearm are tightly encircled by the training aid it may be appreciated that the training aid resists bending of the wrist either inwardly or outwardly. Thus, the wrist is maintained rigid and a racquet or golf club becomes "an extension of the arm" of the participant. The term "extension of the arm" is a term of art utilized by teachers of these sports to emphasize the desirability of maintaining a locked or rigid wrist.

Having thus described an operative embodiment of the present invention, what is claimed is:

1. In a removable support training aid for golf or tennis or the like adapted to be worn on the wrist and hand to prevent bending of the wrist in either direction without interfering with the normal gripping action of the hand including a relatively thin generally U-shaped member having a base and opposed spaced apart first and second elongated legs; said base being enlarged in a direction parallel to the elongated axis of said legs to define an enlarged base to fit over the back of the hand, the back of the wrist and the back of the lower portion of the forearm of the wearer; said first leg being wider than said second leg in a direction transverse to the longitudinal axis of the legs; and fastener means attached to the distal end of each leg and to the base for individually fastening each leg to the base; the improvement comprising:

the fastener means attached to said base to define a pocket between said fastener means and said base to receive a removable reinforcing member therein;

so that upon placing the training aid base on the back of the hand, the back of the wrist and the back of the forearm, said first leg may be encircled around the wrist and forearm of the wearer and attached to the base and the second leg extended between the thumb and forefinger and encircled across the palm and around the hand to the back of the hand and attached to the base to thereby rigidly reinforce the wrist of the wearer against bending in either direction without interfering with the normal gripping function of the hand.

2. The invention as defined in claim 1 and further including a layer of padding material substantially coextensive with said training aid and secured to the underside thereof to be in contact with the hand of the wearer to reduce irritation and abrasion to the wearer.

3. The invention as defined in claim 1, wherein said training aid is fabricated of a relatively stiff but flexible material such as leather.

4. The invention as defined in claim 1 wherein said fastener means attached to said base is secured along its periphery to said base except that a portion of said fastener means periphery is free of positive securement with said base for removable insertion of a reinforcing member in said pocket.

* * * * *